US005430947A

United States Patent [19]

Courtney

[11] Patent Number: 5,430,947

[45] Date of Patent: Jul. 11, 1995

[54] ATTACHMENT FOR T-SQUARE FOR USE WITH WRITING IMPLEMENT

[76] Inventor: Robert M. Courtney, 47 Horicon Ave., Glens Falls, N.Y. 12801

[21] Appl. No.: 103,479

[22] Filed: Aug. 6, 1993

[51] Int. Cl.[6] ..... B43L 07/08

[52] U.S. Cl. ..... 33/484; 33/485; 33/32.1

[58] Field of Search ..... 33/484, 485, 486, 666, 33/668, 770, 32.1, 32.3

[56] References Cited

U.S. PATENT DOCUMENTS

| | | | |
|---|---|---|---|
| 812,322 | 2/1906 | Badger . | |
| 833,168 | 10/1906 | Keller | 33/485 |
| 1,000,221 | 8/1911 | Wilms . | |
| 1,110,968 | 9/1914 | Southard . | |
| 1,168,362 | 1/1916 | Wood | 33/485 |
| 1,498,485 | 6/1924 | Schmidtke | 33/484 |
| 2,058,091 | 10/1936 | Marsella et al. . | |
| 2,396,877 | 3/1946 | Peterson . | |
| 2,537,473 | 1/1951 | McCusker | 33/484 |
| 2,621,409 | 12/1952 | Dvorak . | |
| 2,681,507 | 6/1954 | Underwood . | |
| 2,835,037 | 5/1958 | Middents | 33/485 |
| 3,284,911 | 11/1966 | Clark . | |
| 3,678,588 | 7/1972 | Isola et al. . | |
| 4,502,225 | 3/1985 | Lin | 33/32.1 |
| 4,507,869 | 4/1985 | Stude | 33/485 |
| 4,979,304 | 12/1990 | Sprague | 33/32.3 |
| 4,999,924 | 3/1991 | Shields . | |
| 5,083,380 | 1/1992 | Robertson | 33/486 |

*Primary Examiner*—Thomas B. Will
*Assistant Examiner*—G. Bradley Bennett
*Attorney, Agent, or Firm*—Kenyon & Kenyon

[57] ABSTRACT

A geometrical instrument for use with a straight edge to mark positions on a flat surface is described. The instrument has a receiver slot on its rear side. The receiver slot extends the width of the instrument such that the instrument can be slideably mounted on the straight edge, The instrument includes a holder to position a writing implement above the receiver slot such that the writing implement marks the flat surface. The instrument also includes a positioning hollow with a centering point aligned with the center of the holder. Additionally, the instrument may include a slot for inserting a knife blade.

9 Claims, 3 Drawing Sheets

ATTACHMENT FOR T-SQUARE FOR USE WITH WRITING IMPLEMENT

FIELD OF INVENTION

The present invention is directed to a geometrical instrument, and more particularly, a geometrical instrument attachable to a T-square to measure and mark, by use of a writing implement, or cut, by use of a knife or blade, points on a flat sheet.

BACKGROUND OF THE INVENTION

Geometrical instruments exist to locate certain points on a flat surface. Builders and other workman often wish to mark points in a straight line on a wall, a piece of sheetrock or other flat sheet stock at certain positions or regular intervals. A straight edge, ruler or yardstick can be used to measure and locate positions to be marked, however these devices are unable to hold a writing implement in place to obtain consistent positioning. Moreover, the angle at which the writing implement is held often affects the location of the point marked.

Other measuring and marking instruments are usually complex, with moving parts, and are made from a multitude of materials. These instruments are costly, require repair, and cannot easily be used in conjunction with existing tools, measuring devices and writing implements.

For example, U.S. Pat. No. 2,681,507 to Underwood relates to a steel rule assembly for marking straight lines on sheet metal. A built-in scribing stub marks a straight line as the slider is moved along the sheet metal. The steel rule assembly of the Underwood patent is made from many parts. Moreover, it does not enable one to mark points on the sheet metal, or mark points using a separate writing implement or separate cutting instrument.

U.S. Pat. No. 2,058,091 to Marsella et al. describes a glass cutting slide. The slide is attached to a T-square so that it snugly embraces the T-square and can move along the T-square on inner rollers. One end of the slide contains a recess for the accommodation of a cutting element. The slide may be shifted along the T-square (or a straight edge) with the cutter depressed and the glass will be cut along the line required. However, the slide is made from numerous and complex parts, and does not enable one to mark a point. Further, the slide of the Marsella et al. patent cannot be used in conjunction with a writing implement. It is further noted that the cutting element is fitted into a recess, rather than placed through a hole from the front of the slide.

Accordingly, it is not known to use a geometrical instrument of a single construction, used in conjunction with a T-square or other straight edge, to make points on a flat surface using a writing implement.

Moreover, it is often also desirable, in addition to marking points on a flat surface, to cut into the flat surface at certain points along or across the flat surface, such that the cuts are perpendicular to the T-square or straight edge.

SUMMARY OF THE INVENTION

The present invention is a geometrical instrument attachable to a T-square or other straight edge to enable one to measure, by use of the straight edge or T-square, and mark, by use of a writing implement, points on a flat surface such as sheetrock, plywood or other flat sheet stock. The straight edge or T-square used in conjunction with the instrument of the present invention should comprise regular markers that measure distance.

The instrument of the present invention is made from one piece of material, such as, for example, a single piece of wood or a single piece of metal or tin or single molded plastic or nylon.

The instrument is designed to be placed over a straight edge or, for example, the long section of a T-square such that the instrument will remain, for example, frictionally engaged to the straight edge or T-square. Alternatively, the instrument may be constructed to snap onto the straight edge or T-square. On the underside of the instrument is a receiver slot or indentation in which the straight edge or T-square can be inserted. In the representative embodiment, the width of the receiver slot corresponds to the width of the straight edge or the width of the long section of the T-square. The length of the receiver slot is the width of the instrument. Accordingly, the instrument is frictionally engaged to, and can slide along, the straight edge or T-square.

The instrument can be made from a flexible material so that it can be bent and then snapped onto the straight edge or T-square at any position. Alternatively, the receiver slot may be shaped so that it grips the straight edge or T-square and/or encompasses the straight edge or T-square. In this case, the instrument is placed on the straight edge or T-square by sliding it on from an end of the straight edge or T-square.

The instrument has a holder for inserting and holding a writing implement, such as, for example, a pencil or pen. Preferably, the holder is cylindrical in shape, and at an angle such that the writing implement will remain in position when it is being used to mark a flat surface, including a vertical surface such as a wall. The holder is used to position the writing implement at a consistent position with respect to the instrument. The user can place the writing implement in the holder and then place a mark on the flat surface using the writing implement.

The instrument also has a window. The window is a cut-out section located on the instrument, usually located over at least part of the receiver slot. When the instrument is placed on the straight edge or T-square, the straight edge or T-square can be seen through the window. This enables the user to see, through the window, the measurement markers on the straight edge or T-square. Preferably, the window is shaped so that a user can easily locate a desired measurement on the straight edge or T-square. In the representative embodiment, the window is square in shape, with a triangle piece rising from the bottom of the square. The apex of the triangle is used as a centering point or measurement locator. Preferably, the top of the window, i.e., the top of the square, is aligned with one edge of the receiver slot such as the top of the receiver slot. The centering point is aligned with the center of the holder.

In an alternative embodiment, the instrument can be made of a clear plastic, therefore not requiring a window because the measurement markers on the straight edge or T-square can be seen through the instrument. However, a centering point is still required, to reference the location of the center of the holder.

The holder, in the representative embodiment, is located above the window such that the center of the holder on the rear side of the instrument is in alignment with the measurement locator. Further, it is preferable for the center of the holder to be located at a specific distance, e.g. one inch, from the top of the receiver slot.

Accordingly, the present invention enables one to place marks, using a writing implement inserted through the holder, at specified or predetermined distances on a flat surface. The shape of the holder keeps the writing implement steady and in position. The instrument can slide along the straight edge or T-square so that marks and points can be placed on the flat surface in a straight line using the writing implement. The window allows the user to correctly position the instrument on the straight edge or T-square.

In further alternative embodiments, in addition to or instead of the holder for the writing implement, the instrument can feature a slot (or slit) above the window. The slot is aligned with the centering point. A knife blade, such as, for example, a standard drywall knife blade, can be inserted into the slot as required to make cuts in the flat surface. In one embodiment, the slot is orientated such that a cut can be made in the flat surface perpendicular to the length of the T-square or straight edge.

DETAILED DESCRIPTION

Figure 1:
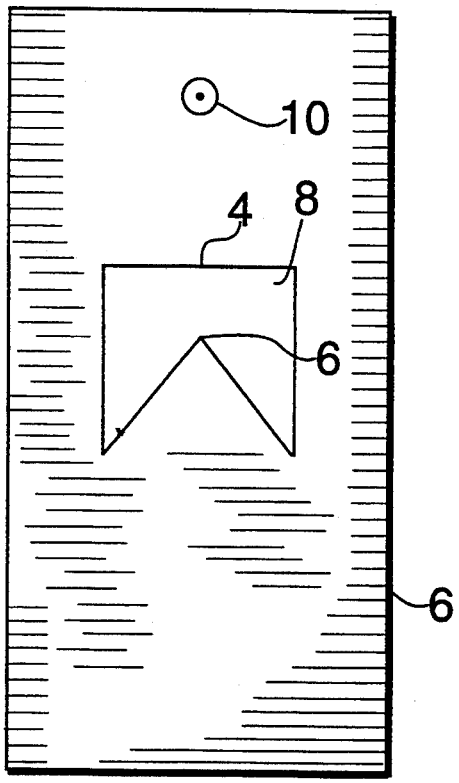
FIG. 1 is a plan view of the instrument of the present invention.

Referring now to the drawings, and initially FIG. 1, there is illustrated a plan view of the instrument 2 of the present invention. The instrument 2 in FIG. 1 is shown as a user would usually view the instrument 2 when using it to mark points on a flat surface.

Figure 3:
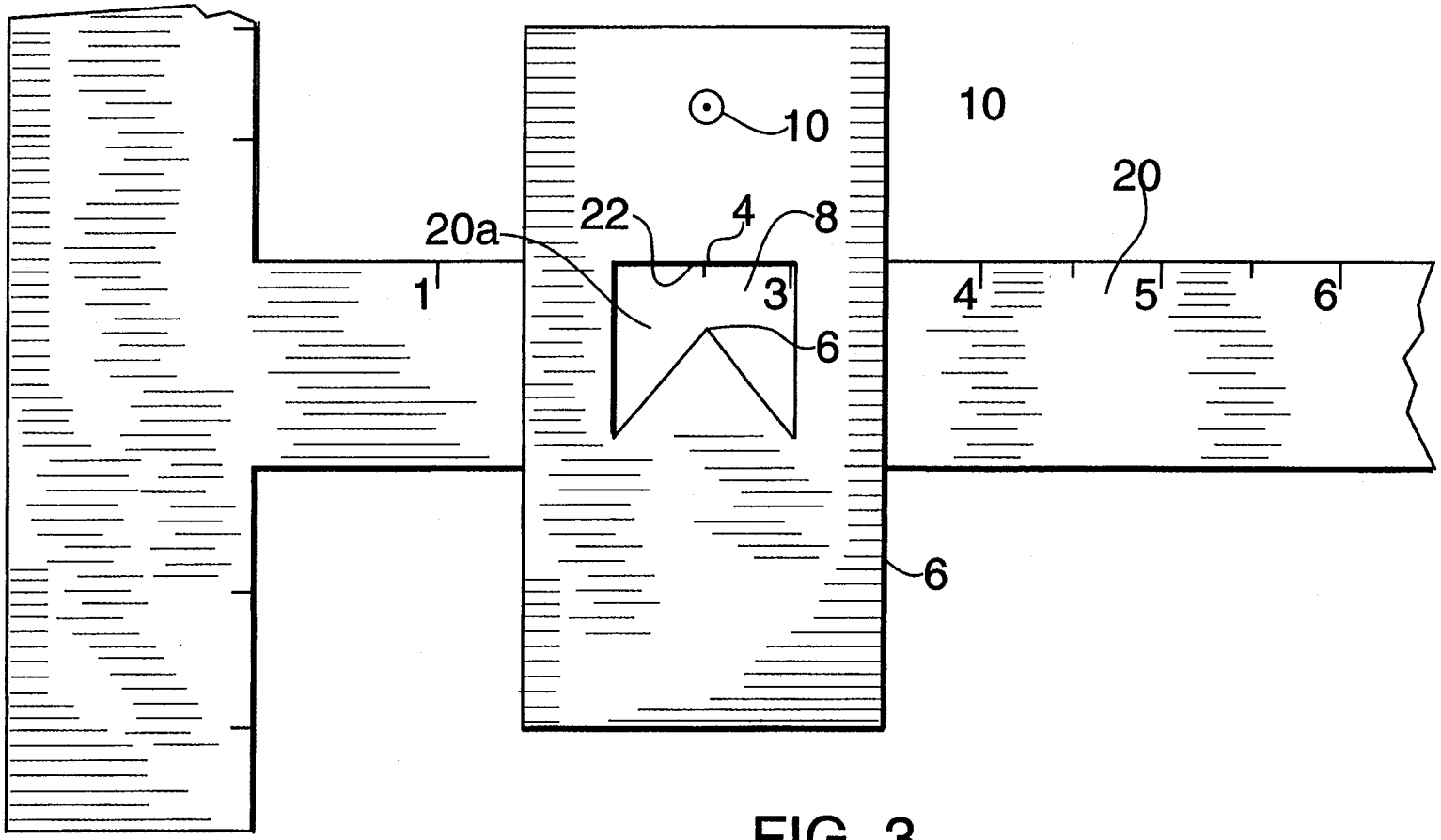
FIG. 3 is a plan view showing the instrument of FIG. 1 as used in conjunction with a T-square.

The instrument 2 can be made from a single piece of material, such as, for example, plastic, wood, tin or metal. The instrument 2 is used in conjunction with a straight edge, such as a T-square (as shown in FIG. 3) or a ruler. Preferably, the straight edge has visible distance markings.

In the representative embodiment, the instrument 2 is rectangular in shape and a holder 10 is located midway between each long side of the instrument 2. The holder 10 can be cylindrical in shape, and is used to hold in position a writing implement (not shown), such as a pen or a pencil. The writing implement can be inserted into the holder 10 from the front side of the instrument 2. The holder 10 is a hollow hole that goes completely through the instrument 2. Accordingly, the instrument 2 should have a depth such that the nib of a pen or the point of a pencil, when placed in the holder 10, will protrude out or through the rear of the instrument and come in contact with any surface on which the instrument 2 is placed.

The instrument 2 also includes a window 8. The window 8 is a hollow section through which the user can see the surface on which the instrument 2 is placed. In the representative embodiment, the window 8 is basically square in shape. From one side of the window 8 protrudes centering point 6. (However, in an alternative embodiment, the centering point 6 could instead be a mark on the edge of the window 8.) In the representative embodiment, the centering point 6 is a triangular shaped piece that is located in the window 8, the apex of the triangle being the exact centering point 6. The centering point 6 is aligned with the center of the holder 10. The holder 10 can be located above the window 10, with the centering point 6 in the window pointing to the center of the holder 10.

It is noted that neither the holder 10 nor the centering point 6 needs to be midway between the two long sides of the instrument 2, provided that the centering point 6 is aligned with the holder 10.

In the representative embodiment, the holder 10 has a one quarter inch diameter. The length of the instrument 2 is four inches, the width of the instrument 2 is two inches, and the depth of the instrument is $\frac{5}{8}$th of an inch.

Figure 2:
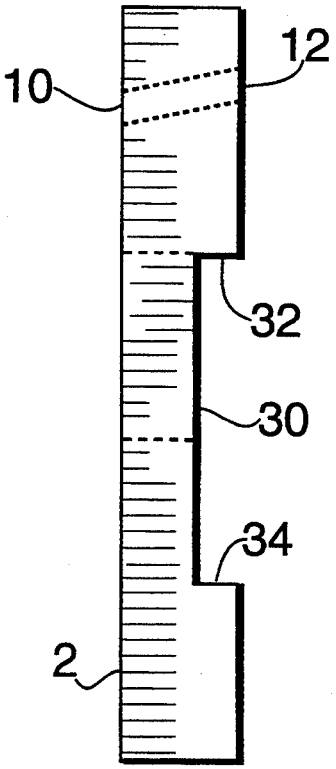
FIG. 2 is a side elevational view of the instrument of FIG. 1.

Turning now to FIG. 2, there is illustrated a side elevational view of the instrument 2 of FIG. 1. The front of the instrument 2 (i.e., the side visible in FIG. 1) is located on the left side of instrument as shown in FIG. 2. A receiver slot 30 is located on the rear side of the instrument 2. The receiver slot 30 extends the width of the instrument. The depth of the receiver slot 30, i.e., the length of edges 32 and 34, is preferably the depth of the straight edge used in conjunction with the instrument 2. Thus, the instrument 2 can be placed over the straight edge, with the straight edge fitting into the receiver slot 30, as is discussed below with reference to FIG. 3.

As shown in FIG. 2, the holder 10 is angled such that the distance between the center of the holder 10 on the front side on the instrument and the window 8 is less than the distance between the center of the holder 12 on the rear side of the instrument and the window 8. This will help to keep the writing implement in position and enable consistent marking of the flat surface with the writing implement.

The center of the holder 10 on the rear side of the instrument is preferably located at the predetermined position above the top side 32 of the receiver slot 30. This enables a user to know that exact location, both length and height, of any mark made with the writing implement when used in conjunction with the present invention. Also, for simplicity of design, the top side 32 of the receiver slot 30 can be aligned with the top side 4 of the window 8.

Turning now to FIG. 3, there is illustrated the instrument 2 as used in conjunction with a T-square 20. Although a T-square 20 is illustrated in FIG. 3, any solid measuring instrument, such as, for example, a straight edge, ruler or yardstick can be used instead of the T-square 20. The instrument 2 is placed on the T-square 20 such that the T-square 20 fits into the receiver slot 30. In one embodiment, the instrument 2 is frictionally engaged to the T-square 20. Also, if the instrument 2 is made of a flexible substance, such as plastic, the instrument 2 may be bent and snapped onto the T-square 20 so that the edges 32 and 34 of the receiver slot 30 clasp the T-square. The dimensions of the receiver slot 30 in relation to the width of the T-square 20 are such that the instrument 2 can be slideably mounted on the T-square 20. In an alternative embodiment, the edges 32 and 34 may include protrusions that fit around the rear side of the T-square 20, or clasps onto the T-square 20.

As shown in FIG. 3, the user can view the T-square 20*a* through the window 8. The centering point 6 can be aligned with a measurement indicator 22 marked on the T-square 20*a* by sliding the instrument 2 along the T-square 30 to the desired position. For example, the measurement indicator 6 as shown in FIG. 3 is aligned with the two-and-a-half inch measurement indicator 22 on the T-square 20*a*.

In the representative embodiment, as stated above, the top side 32 of the receiver slot 30 can be aligned with the top side 4 of the window 8. Moreover, the top side 4 of the window 8 can be aligned with the top edge 24 of the T-square 20. Thus, as the holder 10 is a known distance from the top side 4 of the window 8, the exact location of the holder 10 will be known.

By way of example, it is common for wooden studs in the frame of a house to be located at fixed intervals in a sheetrock wall. If the distance between studs is known, for example, every sixteen inches, the T-square 20, with the instrument 2 mounted thereon, can be placed on the wall and the instrument 2 can be moved along the T-square 20 to the sixteen inch, thirty-two inch, forty-eight inch, etc, positions on the T-square 20. Each time the correct position is located using the centering point 6, a writing implement can be placed in the holder 10 and a virtual mark can be made on the wall at the position indicated by the centering point 6. Accordingly, the instrument 2 of the present invention will enable more accurate locating, measuring and marking. Further, the instrument 2 of the present invention can speed up measuring and accurate marking activities for builders.

It is noted that, because the holder 10 can be angled as discussed above, the writing implement can be placed in the holder 10 such that it remains in position when it is not being used.

Figure 4A:
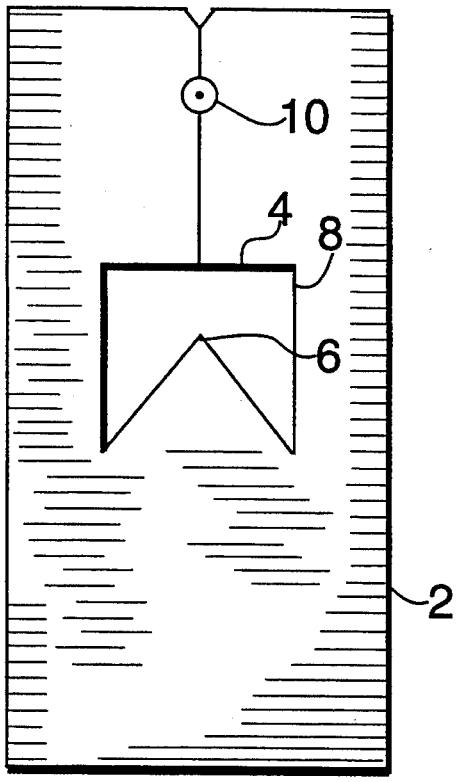
FIG. 4*a* is a plan view of a further embodiment of the instrument of the present invention.
Figure 4B:
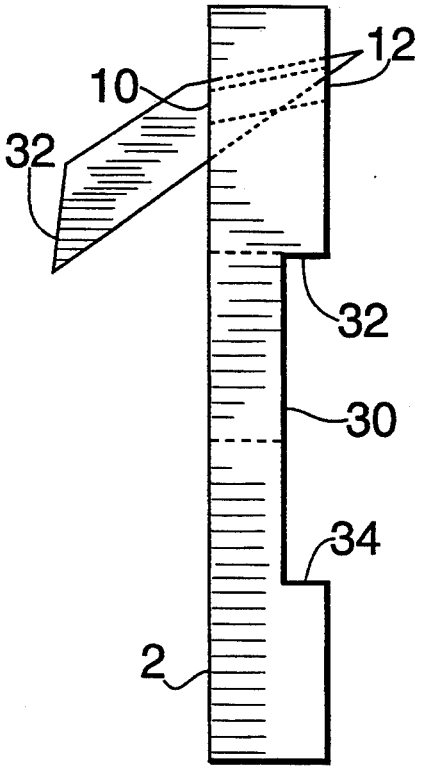
FIG. 4*b* is a side elevational view of the instrument of FIG. 4*a*.

Turning now to FIGS. 4*a* and 4*b*, there is illustrated a further embodiment of the instrument of the present invention. In this embodiment, in addition to the holder 10 for the writing implement, the instrument 2 can feature a slot 30 above the window 8. The slot 30 is aligned with the centering point 6. (In an alternative embodiment, the holder 10 may be omitted, with instrument 2 including merely a slot.) A knife blade 32, such as, for example, a standard drywall knife blade, a razor or other cutting instrument, can be inserted into the slot 30 as required to make cuts or marks in or on the flat surface.

In the embodiment as shown in FIGS. 4a and 4b, the slot 30 is orientated such that a cut can be made in the flat surface perpendicular to the length of the T-square 20 or straight edge. However, the orientation or positioning of the slot 30 need not be so limited.

What is claimed is:

1. A geometrical instrument for use with a straight edge to cut positions on a flat surface, the instrument having a front side and a rear side, the instrument comprising:

a receiver slot located on the rear side, the receiver slot extending the width of the instrument such that the instrument can be slideably mounted on the straight edge;

a slit to position with respect to the receiver slot a cutting implement such that the cutting implement is capable of cutting the flat surface perpendicular to the straight edge; and a window with a centering point, the window being aligned with the receiver slot so that the straight edge may be viewed through the window, the centering point being aligned with the slit;

wherein the slit extends in a direction perpendicular to the straight edge such that the cutting implement is capable of cutting the flat surface in a direction perpendicular to the straight edge.

2. The geometrical instrument of claim 1 wherein the instrument is made from a single material.

3. The geometrical instrument of claim 1 wherein the instrument is made from plastic.

4. The geometrical instrument of claim 1 wherein the instrument is made from metal.

5. The geometrical instrument of claim 1 wherein the straight edge includes distance markings and wherein the position and size of the window allows display of distance markings on the straight edge.

6. The geometrical instrument of claim 1 wherein the straight edge is a T-square and the instrument is frictionally engaged to the T-square.

7. The geometrical instrument of claim 1 wherein the straight edge is a T-square and the instrument is made of a flexible substance and is snapped onto the T-square.

8. The geometrical instrument of claim 1 wherein the instrument further comprises a holder to hold a writing implement.

9. A geometrical instrument for use with a straight edge to mark and cut positions on a flat surface, the instrument having a front side and a rear side, the instrument comprising:

a receiver slot located on the rear side, the receiver slot extending the width of the instrument such that the instrument can be slideably mounted on the straight edge;

a holder to position with respect to the receiver slot a writing implement such that the writing implement is capable of marking the flat surface;

a slit to position with respect to the receiver slot a cutting implement such that the cutting implement is capable of cutting the flat surface perpendicular to the straight edge; and a window with a centering point, the window being aligned with the receiver slot so that the straight edge may be viewed through the window, the centering point being aligned with the slit and the center of the holder;

wherein the slit extends in a direction perpendicular to the straight edge such that the cutting implement is capable of cutting the flat surface in a direction perpendicular to the straight edge.

* * * * *